United States Patent [19]

Peeler et al.

[11] 4,192,355

[45] Mar. 11, 1980

[54] APPARATUS FOR LOOMS HAVING FLUID OPERATED YARN INSERTION MEANS

[75] Inventors: Burin A. Peeler, Shelby; Henry P. Neisler, Kings Mountain, both of N.C.

[73] Assignee: Dicey Fabrics, Inc., Shelby, N.C.

[21] Appl. No.: 968,620

[22] Filed: Dec. 11, 1978

[51] Int. Cl.[2] ..... D03D 47/28

[52] U.S. Cl. ..... 139/435; 139/192

[58] Field of Search ..... 139/435, 192, 452

[56] References Cited

U.S. PATENT DOCUMENTS

| | | | |
|---|---|---|---|
| 3,565,122 | 2/1971 | Jansa et al. | 139/435 |
| 3,705,608 | 12/1972 | Vermeulen | 139/435 |
| 3,857,418 | 12/1974 | Kida et al. | 139/435 |
| 3,958,609 | 5/1976 | Zollinger et al. | 139/435 |

*Primary Examiner*—Henry Jaudon

*Attorney, Agent, or Firm*—Bailey, Dority & Flint

[57] ABSTRACT

A loom is illustrated having fluid insertion means for filling yarn including a reed having upper and lower tunnel means receiving filling yarn for disposition through opposed openings into respective sheds especially for weaving velvet and similar cloth constructions.

3 Claims, 6 Drawing Figures

APPARATUS FOR LOOMS HAVING FLUID OPERATED YARN INSERTION MEANS

BACKGROUND OF THE INVENTION

Fluid operated looms are known to the prior art utilizing a bulge or tunnel-like configuration such as that illustrated in U.S. Pat. No. 3,958,609, wherein a single shed construction accommodates a single filling yarn. Such a device is incapable of inserting more than one pick simultaneously as would be necessary for velvet and the like. U.S. Pat. No. 3,705,608 illustrates a loom of the same general type as is illustrated in connection with this invention, but wherein the invention includes spaced jets energized successively for pulling the weft yarn into the shed. U.S. Pat. No. 3,565,122 illustrates spaced tunnels for operating in connection with a single shed for introducing filling from opposite sides of the loom.

Accordingly, it is an important object of this invention to provide a fluid operated loom wherein more than one filling yarn may be inserted simultaneously, preferably in two sheds so as to facilitate the manufacture of velvet or other cloth constructions wherein a plurality of filling yarns are inseted simultaneously.

Another important object of this invention is to provide an improved loom wherein a reed having spaced tunnel portions facilitate the insertion of measured amounts of filling yarn from one side of the loom simultaneously in respective tunnel portions facilitating a variety of cloth constructions.

BRIEF DESCRIPTION OF THE INVENTION

It has been found that an improved loom construction may be provided by utilizing a reed having spaced superposed tunnel arrangements for receiving respective fluid inserted filling yarns from a metering arrangement including fluid operated means for measuring predetermined amounts of yarns to be fed on each pick.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a loom having spaced fluid insertion means for carrying respective filling yarns into a shed. A reed is provided comprising a plurality of spaced aligned dents defining spaced yarn tunnels A and B within a shed S for receiving respective filling yarns Y from respective fluid insertion means. The tunnels have opposed yarn exit eyes C opening inwardly toward each other in opposed relation. An intermediate connecting portion D of each of the dents between the tunnels receive adjacent filling yarns from adjacent tunnels and thereafter beat up the filling yarns into a fell F of the cloth being woven.

Figure 1:
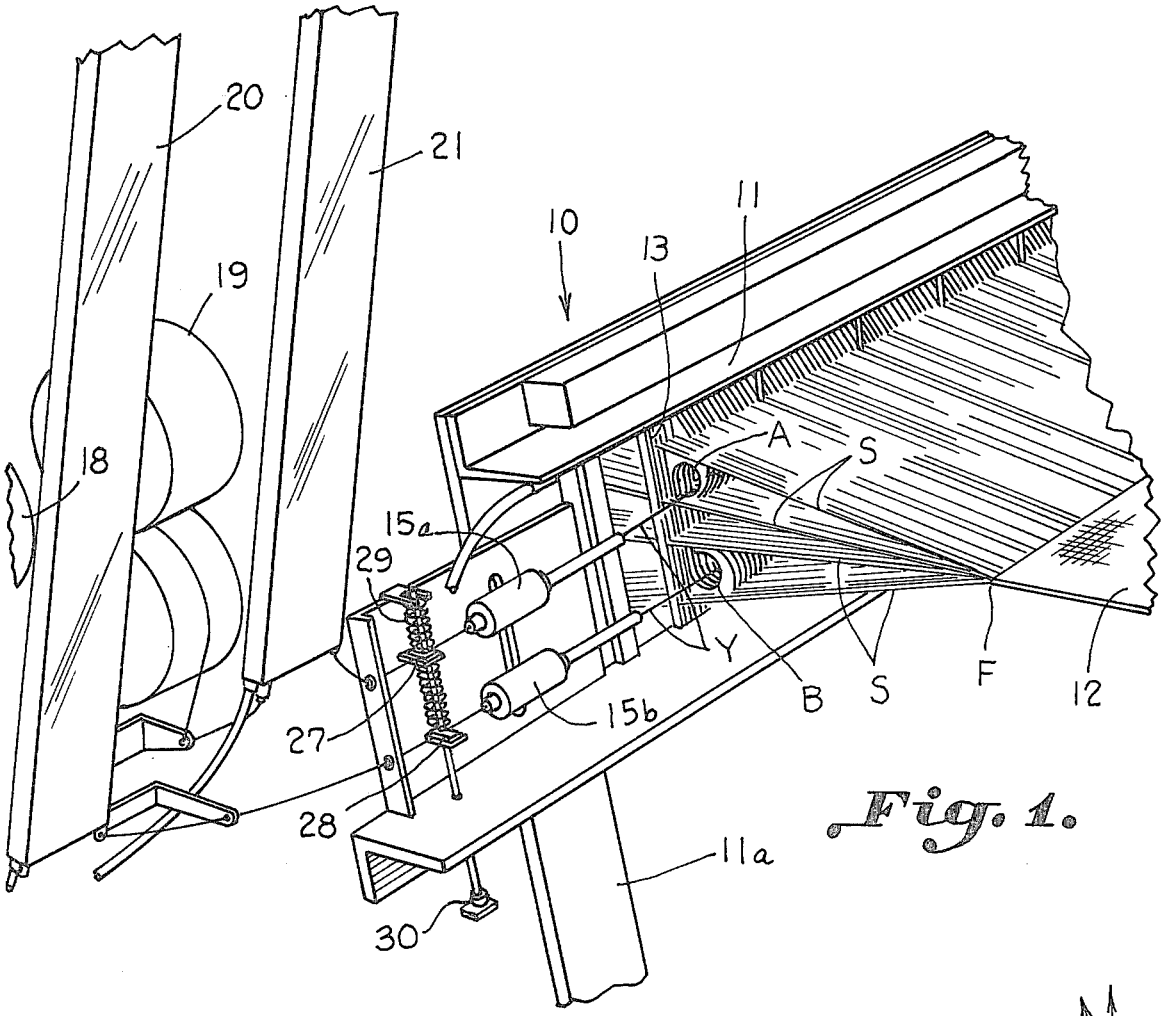
FIG. 1 is a perspective view illustrating a loom constructed in accordance with the present invention schematically illustrating the reed, yarn measuring and fluid insertion means therefor.
Figure 2:
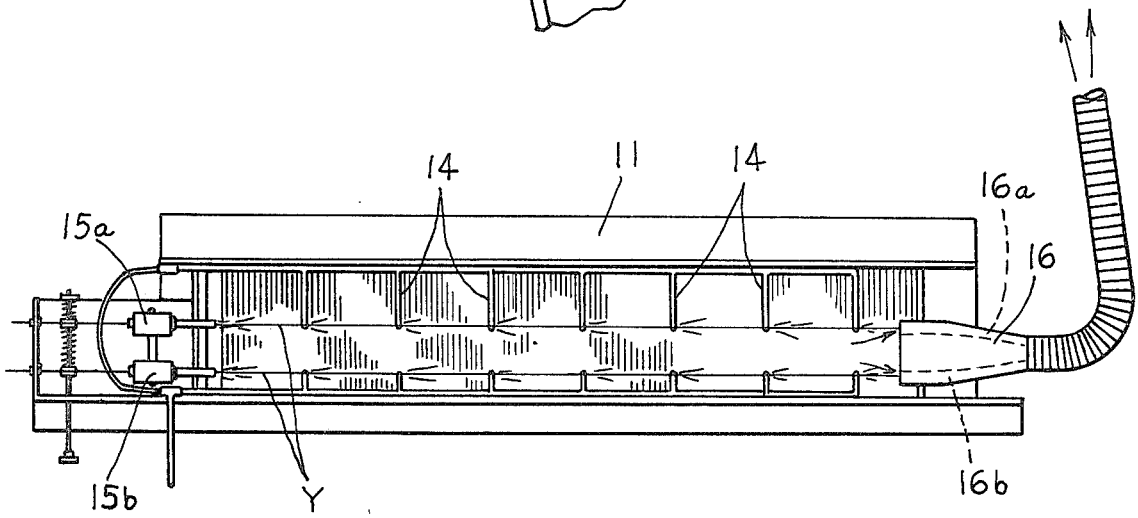
FIG. 2 is a front elevation illustrating a reed constructed in accordance with the present invention with spaced fluid insertion means therealong.
Figure 3A:
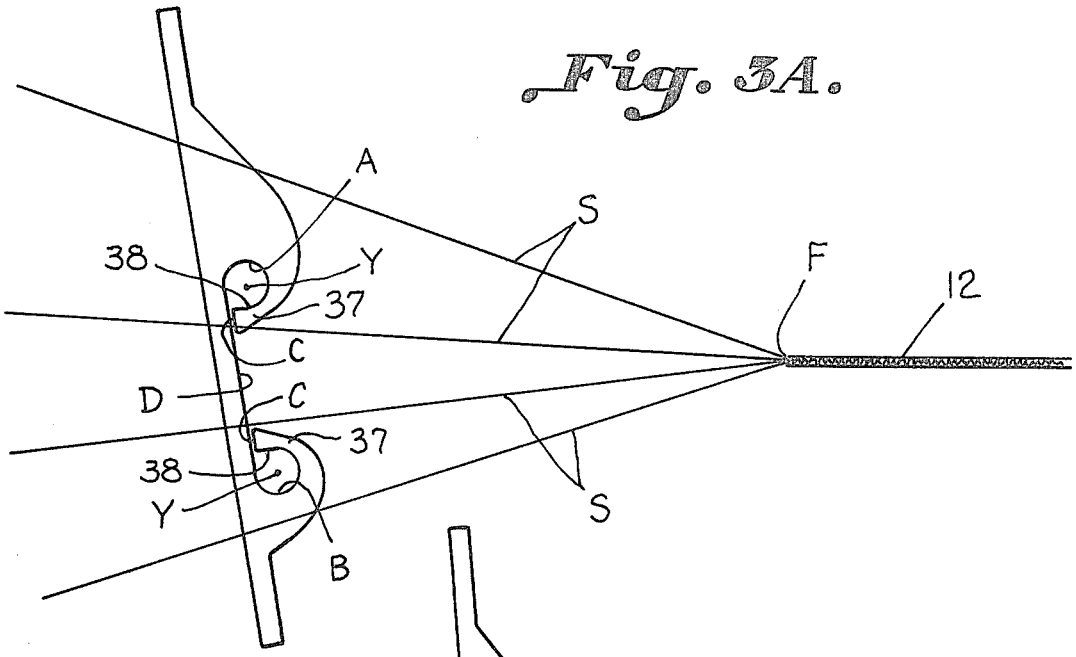
FIG. 3A is a side elevation illustrating a reed dent constructed in accordance with the present invention with the reed shown in connection with upper and lower sheds with the fell of the cloth being woven with the reed in at back center and the filling yarn inserted into the tunnel.
Figure 3B:
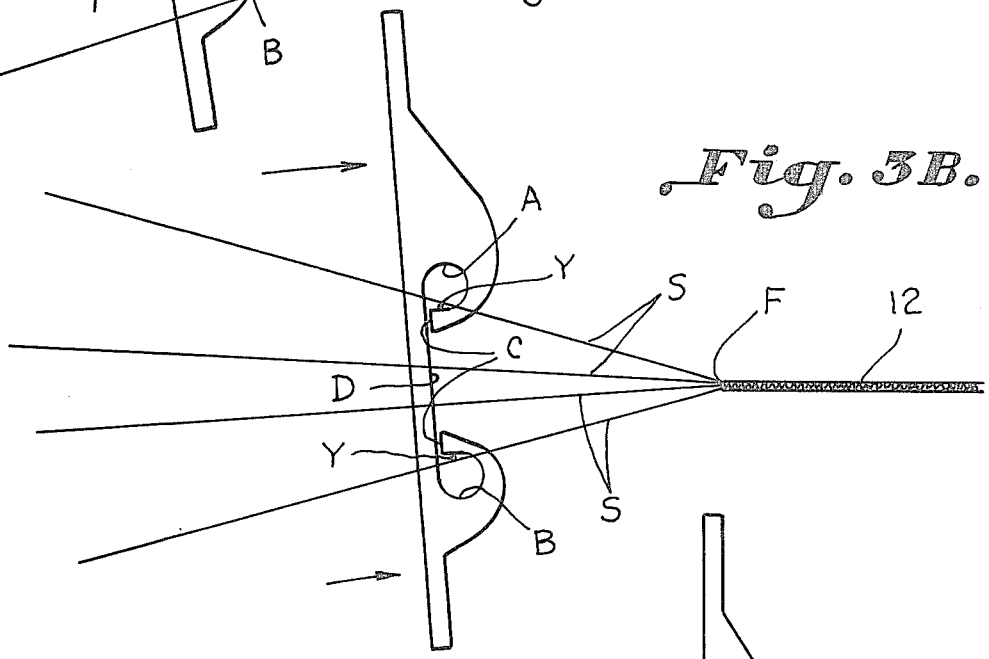
FIG. 3B is a schematic illustration of the reed in accordance with FIG. 1 positioned halfway between back center and front center with the filling yarn about to emerge inwardly toward each other from opposed exit eyes of the tunnels.
Figure 3C:
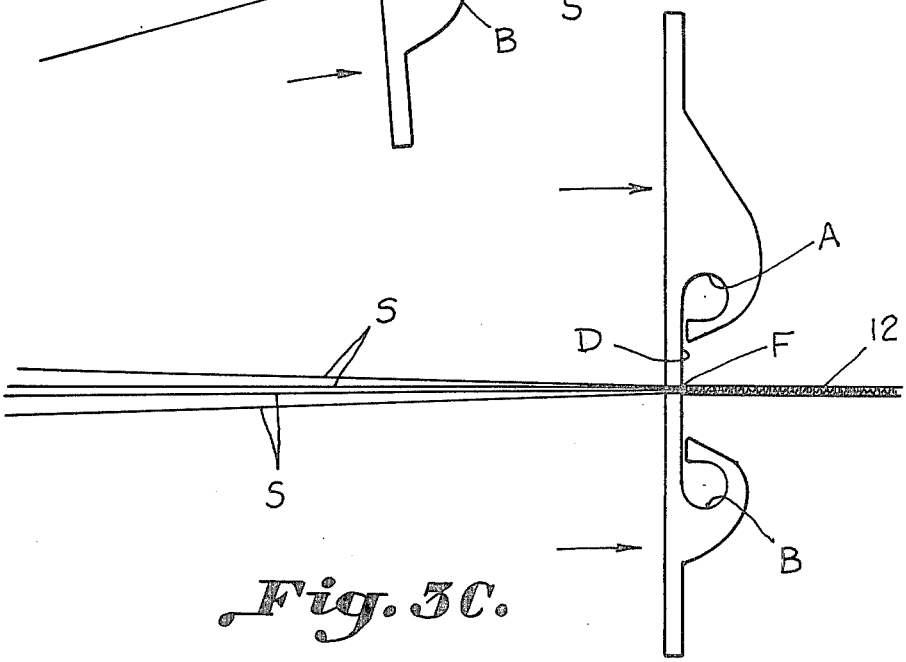
FIG. 3C is a schematic illustration of the reed shown in FIGS. 3A and 3B with the reed in front center and filling yarn having been beaten up into the fell of the cloth.

Referring more particularly to FIG. 1, a fluid operated loom is broadly designated at 10 having a reed 11 mounted for oscillation back and forth on lay swords 11*a* during weaving of the cloth 12. The reed includes a number of dent wires 13 of standard construction for permitting passage of the yarn Y for reception in a respective yarn receiving tunnel A and B. In FIG. 2, the reed is illustrated as carrying a plurality of spaced nozzles 14 which may operate simultaneously or successively to draw the filling yarn Y through the shed in the tunnel portions A and B defined by the tunnel openings in respective reed dents as best illustrated in FIGS. 3A, 3B and 3C. The fluid insertion means include vertically spaced nozzles 15*a* and 15*b*, respectively, together with a suction nozzle assembly 16 which has spaced upper and lower suction openings 16*a* and 16*b*, respectively. It may be advantageous to space the nozzles 14 progressively closer together from left to right, as opposed to the equal spacing shown, in order to compensate for reduction in air pressure.

Figure 4:
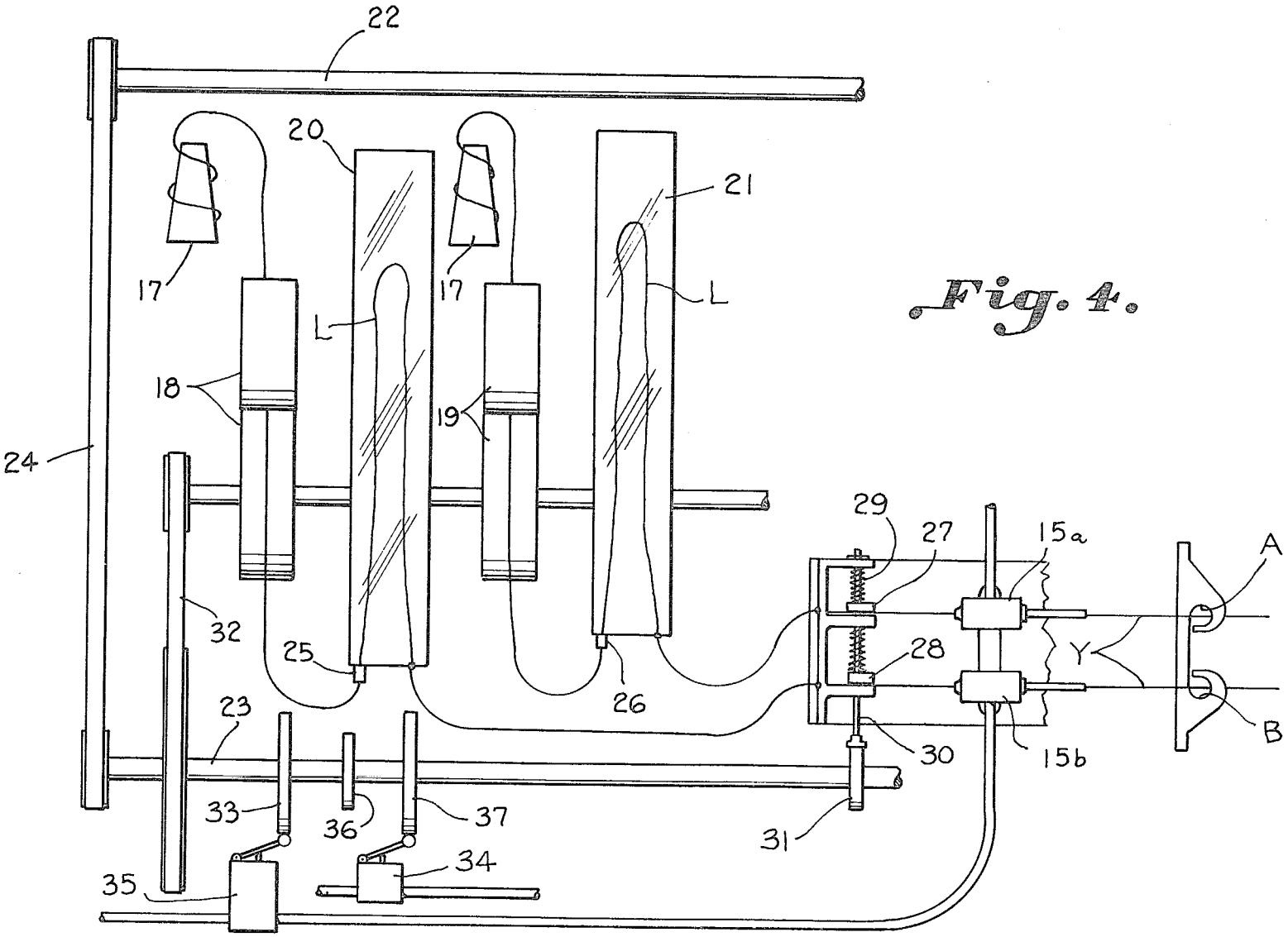
FIG. 4 is a diagramatic illustration of the yarn measuring apparatus and controls for introducing yarn into the sheds at predetermined lengths.

The apparatus for sequentially measuring predetermined amounts of yarn for insertion into the upper and lower sheds illustrated in FIGS. 1, 3A, 3B and 3C, is diagramatically illustrated in FIG. 4 and includes supply packages 17 and two pairs of metering or measuring rollers 18 and 19 feeding predetermined lengths of yarn, respectively, into open ended chambers 20 and 21. The loom crank shaft 22 drives the intermediate shaft 23 through a suitable timing belt 24. Air jets 25 and 26 carry the yarn and maintain same in loops L within the respective chambers 20 and 21, respectively, while the gripper means 27 and 28 are engaged. The gripper includes a compression spring 29 which urges the shaft 30 downwardly in FIG. 4 but which is yieldable when operated by the cam 31 carried by the intermediate shaft 23. It will be noted that the measuring rollers 18 and 19 are driven as by a belt drive 32 from the intermediate shaft 23.

The cam 33 releases or opens the valves supplying fluid in the form of air to the respective nozzles 15*a* and 15*b*. This starts the weft yarn across the loom. The cam 36 operates a knife motion (not shown) and cuts the weft yarn into the measured lengths. The cam 36 controls the air to all of the secondary jets or nozzles 14 which carry the yarn along the tunnel areas for reception into the suction device 16.

It will be noted that opposed inwardly facing tunnel eyes C are formed between an intermediate reed dent portion having a forward yarn receiving face of the intermediate connection portion D and scroll portions 37 which extend toward, but terminate short of the face of the connecting portion D, FIG. 3A. In operation, the inserted pick yarn Y passes along an inner portion of the scroll 38 toward a respective eye C as the shed progressively closes during weaving, as illustrated in FIGS. 3A, 3B and 3C preparatory to beat up into the cloth.

While a preferred embodiment of the invention has been described using specific terms, it is to be understood that changes and variations may be made without departing from the spirit or scope of the following claims.

What is claimed is:

1. For use in a loom having spaced fluid insertion means for carrying respective filling yarns into a shed, a reed comprising:

a plurality of spaced aligned dents defining spaced yarn tunnels within a shed for receiving respective filling yarns from said fluid insertion means;

said tunnels having opposed yarn exit eyes opening toward each other in opposed relation; and an intermediate connecting portion of each of said dents between said tunnels receiving adjacent filling yarns from adjacent tunnels and thereafter beating up the filling yarns into a fell of the cloth being woven.

2. A reed dent for fluid inserted yarn comprising:

spaced yarn tunnels for receiving respective filling yarns from fluid insertion means;

said tunnels having opposed yarn exit eyes opening toward each other in opposed relation; and an intermediate connecting portion between said tunnels receiving adjacent filling yarns from adjacent tunnels thereafter beating up the filling yarns into a fell of the cloth being woven.

3. The structure set forth in claim 2, wherein said yarn tunnels are formed from opposed curved scrolls over which respective filling yarns pass preparatory to passing through the exit eyes for beat up into the fell of the cloth.

* * * * *